US012595527B2

(12) United States Patent
Matsumoto et al.

(10) Patent No.: US 12,595,527 B2
(45) Date of Patent: Apr. 7, 2026

(54) STEEL WIRE FOR MACHINE STRUCTURAL PARTS AND METHOD FOR MANUFACTURING THE SAME

(71) Applicant: Kobe Steel, Ltd., Kobe (JP)

(72) Inventors: Yosuke Matsumoto, Kobe (JP); Kenshi Ikeda, Kobe (JP); Takuya Kochi, Kobe (JP); Masayuki Sakata, Kobe (JP); Tatsunori Uchida, Kobe (JP); Koji Yamashita, Kobe (JP); Yuta Inoue, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 418 days.

(21) Appl. No.: 18/551,541

(22) PCT Filed: Mar. 22, 2022

(86) PCT No.: PCT/JP2022/013270

§ 371 (c)(1),
(2) Date: Sep. 20, 2023

(87) PCT Pub. No.: WO2022/210124

PCT Pub. Date: Oct. 6, 2022

(65) Prior Publication Data

US 2024/0167116 A1 May 23, 2024

(30) Foreign Application Priority Data

Mar. 31, 2021 (JP) ..... 2021-061572
Dec. 24, 2021 (JP) ..... 2021-211498

(51) Int. Cl.
*C21D 9/52* (2006.01)
*C21D 1/18* (2006.01)
(Continued)

(52) U.S. Cl.
CPC ..... *C21D 9/525* (2013.01); *C21D 1/18* (2013.01); *C21D 1/32* (2013.01); *C21D 6/002* (2013.01);
(Continued)

(58) Field of Classification Search
None
See application file for complete search history.

(56) References Cited

U.S. PATENT DOCUMENTS 8,343,288 B2 * 1/2013 Murakami ..... C22C 38/06 148/330
2016/0333437 A1 * 11/2016 Sakamoto ..... C22C 38/04
(Continued)

FOREIGN PATENT DOCUMENTS

CN 107406949 A * 11/2017 ..... C22C 38/60
JP 2011-256456 A 12/2011
(Continued)

OTHER PUBLICATIONS

International Search Report Issued Jun. 14, 2022, in PCT/JP2022/013270, filed on Mar. 22, 2022, therein, 2 pages.
(Continued)

*Primary Examiner* — Devang R Patel
(74) *Attorney, Agent, or Firm* — Oblon, McClelland, Maier & Neustadt, L.L.P.

(57) ABSTRACT

A steel wire for machine structural parts, may include Fe, inevitable impurities, and, by mass: 0.05 to 0.60% C; 0.005 to 0.50% Si; 0.30 to 1.20% Mn; more than 0 to 0.050% P; more than 0 to 0.050% S; 0.001 to 0.10% Al; more than 0 to 1.5% Cr; and more than 0 to 0.02% N. An area of cementite present at ferrite grain boundaries in an area of all cementite of the steel wire may be 32% or more. When a C content (% by mass) of a steel is expressed as [C], an average circular-equivalent diameter of all the cementite is
(Continued)

(1.668-2.13 [C]) μm or more and (1.863-2.13 [C]) μm or less.

19 Claims, 5 Drawing Sheets

(51) Int. Cl.

| | |
|---|---|
| ***C21D 1/32*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |

(52) U.S. Cl.
CPC ..... *C21D 6/005* (2013.01); *C21D 6/008* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01)

(56) References Cited

U.S. PATENT DOCUMENTS

| | | | | |
|---|---|---|---|---|
| 2018/0105894 | A1* | 4/2018 | Sasaki | C22C 38/60 |
| 2020/0048731 | A1* | 2/2020 | Manabe | C21D 6/008 |
| 2021/0404039 | A1* | 12/2021 | Lee | C21D 9/64 |

FOREIGN PATENT DOCUMENTS

| | | | | |
|---|---|---|---|---|
| JP | 2012-140674 | A | 7/2012 | |
| JP | 2015-183265 | A | 10/2015 | |
| JP | 2016-194100 | A | 11/2016 | |
| JP | 2017-48459 | A | 3/2017 | |
| KR | 100285258 | B1 * | 4/2001 | C22C 38/22 |
| WO | WO-2006088019 | A1 * | 8/2006 | C22C 38/02 |

OTHER PUBLICATIONS

International Preliminary Report on Patentability and Written Opinion issued Oct. 12, 2023, in PCT/JP2022/013270 (with English Translation), 10 pages.

* cited by examiner

STEEL WIRE FOR MACHINE STRUCTURAL PARTS AND METHOD FOR MANUFACTURING THE SAME

CROSS-REFERENCE TO RELATED APPLICATIONS

The present application is the national stage of international application PCT/JP2022/013270, filed on Mar. 22, 2022, and claims the benefit of the filing date of Japanese Appl. No. 2021-061572, filed on Mar. 31, 2021, and of the filing date of Japanese Appl. No. 2021-211498, filed on Dec. 24, 2021.

TECHNICAL FIELD

The present disclosure relates to a steel wire for machine structural parts and a method for manufacturing the same.

BACKGROUND ART

In the manufacturing of various types of machine structural parts, such as automobile parts and construction machinery parts, bar steels including hot-rolled wire rods are usually subjected to spheroidizing annealing for the purpose of imparting cold-workability thereto. The steel wire obtained by the spheroidizing annealing is then subjected to cold working, followed by machining such as cutting, thereby forming a part with a predetermined shape. Further, a final strength adjustment is performed on the part by quenching and tempering, whereby a machine structural part is manufactured.

In recent years, there has been a demand for even softer steel wire than before in order to prevent cracking of steel material and improve the lifespan of dies during the cold working process.

As a method for obtaining a softened steel wire, for example, Patent Document 1 discloses a method for manufacturing a medium-carbon steel with excellent cold forgeability, which involves heating steel up to an austenitizing temperature range two or more times in the spheroidizing annealing process. According to the manufacturing method mentioned in Patent Document 1, it is indicated that a cold forgeable steel having a hardness of 83 HRB or less after the spheroidizing annealing and a spherical carbide ratio of 70% or more in the microstructure can be obtained.

Patent Document 2 discloses a steel material having low deformation resistance after the spheroidizing annealing and excellent cold forgeability, as well as a method for manufacturing the steel material. In the manufacturing method, steel satisfying a predetermined composition is hot-worked, cooled to room temperature and then has its temperature increased to a temperature range of A1 point to A1 point+50° C. After the temperature increase, it is held in the temperature range of the A1 point to A1 point+50° C. for 0 to 1 hour. Subsequently, after performing the annealing process two or more times by cooling at an average cooling rate of 10 to 200° C./hour from the temperature range of the A1 point to A1 point+50° C. to the temperature range of A1 point−100° C. to A1 point−30° C., the steel has its temperature increased to the temperature range from the A1 point to A1 point+30° C. and held in the temperature range from the A1 point to A1 point+30° C., followed by cooling. Specifically, after the temperature of the steel reaches the A1 point in increasing the temperature and held in the temperature range of the A1 point to A1 point+30° C., when cooling the steel, a dwell time in the temperature range of the A1 point to A1 point+30° C. until reaching the A1 point is set to a time between 10 minutes and 2 hours. The steel is cooled from the temperature range of the A1 point to A1 point+30° C. down to a cooling temperature range of A1 point−100° C. to A1 point−20° C. at an average cooling rate of 10 to 100° C./hour, followed by holding for 10 minutes to 5 hours in the cooling temperature range, and then it is further cooled.

Patent Document 3 discloses a steel wire for machine structural parts that can be lower deformation resistance during cold-working, improve the resistance to cracking, and exhibit excellent cold-workability. The steel wire has a predetermined composition, and the metallurgical microstructure of the steel is composed of ferrite and cementite, wherein the ratio of the number of cementite particles in the ferrite grain boundary is 40% or more of the number of all the cementite particles. Patent Document 3 describes the preferred manufacturing conditions for a rolled wire rod to be subjected to spheroidizing annealing as follows: finish rolling at 800° C. or higher and 1050° C. or lower; first cooling at an average cooling rate of 7° C./sec or more, second cooling at an average cooling rate of 1° C./sec or more and 5° C./sec or less, and third cooling at an average cooling rate more than the second cooling rate and also 5° C./sec or less, these cooling processes being performed in this order, with the end of the first cooling and the start of the second cooling in the range of 700 to 750° C., the end of the second cooling and the start of the third cooling in the range of 600 to 650° C., and the end of the third cooling at 400° C. or lower.

PRIOR ART DOCUMENT

Patent Document

Patent Document 1: JP 2011-256456 A
Patent Document 2: JP 2012-140674 A
Patent Document 3: JP 2016-194100 A

DISCLOSURE OF THE INVENTION

Problems to be Solved by the Invention

However, the conventional technologies disclosed in Patent Documents 1 to 3 cannot sufficiently reduce the hardness of steel after the spheroidizing annealing, resulting in either inferior workability in cold-working performed after the spheroidizing annealing or inability to sufficiently enhance the hardness of steel in a quenching process performed after the cold-working, i.e., inferior quenching property. In other words, there is no conventional technology focusing on improving both the cold-workability and hardenability.

The present disclosure has been made in view of such circumstances and has an object to provide a steel wire for machine structural parts that has sufficiently low hardness and excellent cold-workability and can attain high hardness through a quenching process, that is, excellent hardenability, as well as a method for manufacturing a steel wire for machine structural parts that can manufacture the above-mentioned steel wire for machine structural parts in a relatively short period of time.

The terms “wire rod” and “steel bar” as used herein refer to rod-shaped and bar-shaped steel materials, respectively, obtained by hot rolling, and to which neither heat treatment such as spheroidizing annealing nor wire drawing is applied. The term “steel wire” refers to a wire rod or steel bar to which at least one of heat treatment such as spheroidizing annealing and wire drawing has been applied. Herein, the above wire rod, steel bar and steel wire are collectively referred to as a "bar steel".

Means for Solving the Problems

According to a first aspect of the prevent invention, there is provided a steel wire for machine structural parts, including:

C: 0.05% by mass to 0.60% by mass;
Si: 0.005% by mass to 0.50% by mass;
Mn: 0.30% by mass to 1.20% by mass;
P: more than 0% by mass and 0.050% by mass or less;
S: more than 0% by mass and 0.050% by mass or less;
Al: 0.001% by mass to 0.10% by mass;
Cr: more than 0% by mass and 1.5% by mass or less; and
N: more than 0% by mass and 0.02% by mass or less, with the balance being iron and inevitable impurities,
wherein a proportion of an area of cementite present at ferrite grain boundaries in an area of all cementite of the steel wire is 32% or more, and
wherein, when a C content (% by mass) of a steel is expressed as [C], an average circular-equivalent diameter of all the cementite is (1.668-2.13 [C]) μm or more and (1.863-2.13 [C]) μm or less.

In a second aspect of the prevent invention, there is provided the steel wire for machine structural parts according to the first aspect, further including one or more selected from the group consisting of:

Cu: more than 0% by mass and 0.25% by mass or less,
Ni: more than 0% by mass and 0.25% by mass or less,
Mo: more than 0% by mass and 0.50% by mass or less, and
B: more than 0% by mass and 0.01% by mass or less.

In a third aspect of the prevent invention, there is provided the steel wire for machine structural parts according to the first or second aspect, further including one or more selected from the group consisting of:

Ti: more than 0% by mass and 0.2% by mass or less,
Nb: more than 0% by mass and 0.2% by mass or less, and
V: more than 0% by mass and 0.5% by mass or less.

In a fourth aspect of the prevent invention, there is provided the steel wire for machine structural parts according to any one of the first to third aspects, further including one or more selected from the group consisting of:

Mg: more than 0% by mass and 0.02% by mass or less,
Ca: more than 0% by mass and 0.05% by mass or less,
Li: more than 0% by mass and 0.02% by mass or less, and
REM: more than 0% by mass and 0.05% by mass or less.

In a fifth aspect of the prevent invention, there is provided the steel wire for machine structural parts according to any one of the first to fourth aspects, wherein an average ferrite grain size is 30 μm or less.

According to a sixth aspect of the prevent invention, there is provided a method for manufacturing the steel wire for machine structural parts according to any one of the first to fifth aspects, the method including: subjecting a bar steel satisfying the chemical composition according to any one of the first to fourth aspects to spheroidizing annealing, the spheroidizing annealing including the following processes (1) to (3):

(1) heating the steel to a temperature T1 of (A1+8° C.) or higher, and then heating and holding the steel at the temperature T1 for more than 1 hour and 6 hours or less;
(2) performing a cooling-heating process two to six times in total, wherein the cooling-heating process includes cooling the steel to a temperature T2 of higher than 650° C. and (A1−17° C.) or lower at an average cooling rate R1 of 10° C./hour to 30° C./hour, and then heating the steel to a heating temperature of higher than the temperature T2 and (A1+60° C.) or lower; and
(3) cooling the steel from the heating temperature of the final cooling-heating process, where A1 is calculated by the following equation (1):

$$A1(^\circ\,C.)=723+29.1\times[Si]-10.7\times[Mn]+16.9\times[Cr]-16.9\times[Ni] \quad (1)$$

where an expression [element] represents the content of each element (% by mass), and the content of an element not contained is zero.

In a seventh aspect of the prevent invention, there is provided the method for manufacturing the steel wire for machine structural parts according to the sixth aspect, wherein the bar steel is a steel wire obtained by subjecting a wire rod to wire drawing at an area reduction ratio of more than 5%.

Effects of the Invention

According to the present disclosure, a steel wire for machine structural parts with excellent cold-workability and excellent hardenability and a method for manufacturing the steel wire for machine structural parts can be provided.

MODE FOR CARRYING OUT THE INVENTION

Figure 1:
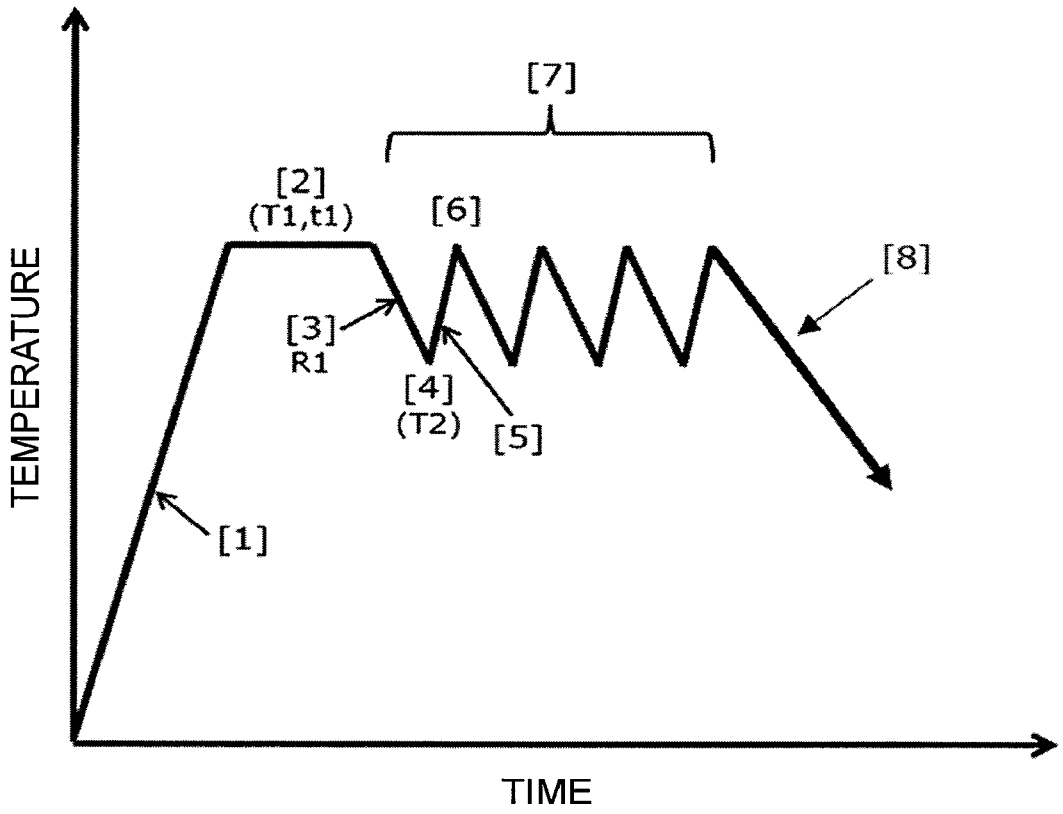
FIG. 1 is a diagram for explaining conditions for spheroidizing annealing in a method for manufacturing a steel wire for machine structural parts according to the present embodiment.

The inventors have studied steel wires from various angles in order to realize a steel wire for machine structural parts with excellent cold-workability and excellent hardenability. As a result, the inventors have found that especially in the metallurgical microstructure, it is advisable to set the proportion of the area of cementite present at the ferrite grain boundaries in the area of all the cementite at a certain level or more and to set an average size of all the cementite within a certain range depending on the C content of the steel. Furthermore, in order to realize the above metallurgical microstructure, the inventors have also found that it is effective to set the chemical composition within a certain range and to perform spheroidizing annealing particularly on the specified conditions in the method for manufacturing the steel wire for machine structural parts. Hereinafter, a description will be given on the steel wire for machine structural parts according to the present embodiment, especially, the metallurgical microstructure of the steel wire for machine structural parts.

1. Metallurgical Microstructure

[Proportion of the Area of Cementite Present at Ferrite Grain Boundaries in the Area of all the Cementite: 32% or More]

When the proportion of cementite present at ferrite grain boundaries is reduced while the proportion of cementite in the ferrite grains is relatively increased, the cementite in the ferrite grains prevents the migration of dislocations introduced into the ferrite grains during cold-working. This results in increased dislocations, exhibiting work hardening, leading to inferior cold-workability. In the present embodiment, the proportion of the area of cementite present at the ferrite grain boundaries in the area of all the cementite is set to 32% or more for the purpose of suppressing the hardening of the steel wire for machine structural parts by reducing the proportion of cementite in the ferrite grains. The "cementite present at ferrite grain boundaries" includes both the cementite in contact with the ferrite grain boundaries and the cementite present on the ferrite grain boundaries. The "proportion of the area of cementite present at the ferrite grain boundaries" is hereinafter referred to as a "grain boundary cementite ratio". The grain boundary cementite ratio is preferably 35% or more, more preferably 40% or more, and even more preferably 45% or more. On the other hand, the higher the grain boundary cementite ratio, the more preferred it is, and thus the upper limit of the grain boundary cementite is not particularly limited and may be 100%.

The form of all the cementite is not particularly limited, and includes spherical cementite as well as bar-shaped cementite with a high aspect ratio. The reference for the size of cementite to be measured is not particularly limited, but the minimum size is defined as the size of cementite that can be determined by a method for measuring the grain boundary cementite ratio mentioned later. Specifically, cementite particles with a circular-equivalent diameter of 0.3 μm or more are to be measured.

[When a C Content (% by Mass) of the Steel is Expressed as [C], the Average Circular-Equivalent Diameter of all the Cementite is (1.668-2.13 [C]) μm or More and (1.863-2.13 [C]) μm or Less]

In the case of the cementite content of the steel being constant, the larger the size of the cementite, the smaller the number density of cementite and the longer the distance between the cementite particles. The longer the distance between the cementite particles in the steel, the more difficult the precipitation strengthening is to perform, and consequently the hardness of the steel can be reduced. From these viewpoints, when the C content (% by mass) of the steel is expressed as [C], the present disclosure sets the average circular-equivalent diameter of all the cementite to be (1.668-2.13 [C]) μm or more. The average circular-equivalent diameter of all the cementite is preferably (1.669-2.13 [C]) μm or more. On the other hand, when the cementite is excessively coarse, the cementite does not dissolve sufficiently when held at a high temperature in a quenching process after cold-working, which cannot obtain a sufficiently high hardness through the quenching. Therefore, in the present disclosure, the average circular-equivalent diameter of all the cementite is set to (1.863-2.13 [C]) μm or less. It is preferably (1.858-2.13 [C]) μm or less.

In Patent Document 3, it is indicated that cementite present at the ferrite grain boundaries receives less strain during cold-workability than cementite present in the ferrite grains, which reduces deformation resistance. However, the average size of all the cementite is not controlled in Patent Document 3, and as a result, the cementite cannot be sufficiently dissolved while holding it at a high temperature in the quenching process, resulting in inferior hardenability.

The present disclosure is directed to a technology focusing on both the grain boundary cementite ratio and the average size of all the cementite in order to realize a steel wire for machine structural parts with excellent cold-workability and excellent hardenability.

The metallurgical microstructure of the steel wire for machine structural parts according to the present embodiment, which is a spheroidized microstructure having spheroidized cementite, can be obtained by subjecting the bar steel, which satisfies the chemical composition to be mentioned later, to spheroidizing annealing to be mentioned later, for example.

The metallurgical microstructure of the steel wire for machine structural parts of the present disclosure is substantially composed of ferrite and cementite. The above "substantially" means that the area ratio of ferrite in the metallurgical microstructure of the steel wire for machine structural parts of the present disclosure is 90% or more, while allowing the area ratio of bar-shaped cementite with an aspect ratio of 3 or more in the metallurgical microstructure to be 5% or less, and also allowing the area ratio of nitrides such as AlN and inclusions other than nitrides to be less than 3% if they hardly adversely affect the cold-workability. Further, the area ratio of the ferrite may be 95% or more.

The term "ferrite" as used herein refers to a portion in which the crystal structure has a bcc structure, and it includes ferrite in pearlite which has a layered structure of ferrite and cementite.

The term "ferrite grains" to be measured for "ferrite grain size" includes, as an evaluation target, crystal grains containing bar-shaped cementite that are formed during spheroidizing annealing due to insufficient spheroidizing, but it does not include, as the target, crystal grains containing bar-shaped cementite (pearlite grains) that have remained since before the spheroidizing annealing. Specifically, it refers to "crystal grains having no cementite in the grains" and "crystal grains having cementite in the grains and in which the shape of cementite can be observed (i.e., the boundary between the cementite and the ferrite can be clearly observed)", all of which can be confirmed when observed at a magnification of 1,000 times using an optical microscope after etching with nital (2% by volume nitric acid and 98% by volume ethanol). Crystal grains in which the shape of cementite cannot be observed at a magnification of 1,000 times using the optical microscope (i.e., in which the boundary between the cementite and ferrite cannot be observed clearly) are not to be judged in the present embodiment, and thus are not included in the "ferrite grains".

[Average Ferrite Grain Size: 30 μm or Less]

The steel wire for machine structural parts according to the present embodiment preferably has an average ferrite grain size of 30 μm or less in the metallurgical microstructure. When the average ferrite grain size is 30 μm or less, the ductility of the steel wire for machine structural parts can be improved, further suppressing the occurrence of cracking during cold-working. The average ferrite grain size is more preferably 25 μm or less, and even more preferably 20 μm or less. The smaller the average ferrite grain size, the more preferred it is, but the lower limit of the average ferrite grain size may be approximately 2 μm in consideration of implementable manufacturing conditions and the like.

(Properties)

The steel wire for machine structural parts according to the present embodiment, which satisfies the following chemical composition and has the metallurgical structure mentioned above, can achieve both low hardness that allows good cold-working and high hardness after a quenching process. In the present embodiment, when the C content (% by mass), Cr content (% by mass), and Mo content (% by mass) in the steel are expressed as [C], [Cr], and [Mo], respectively (the content of an element not contained is zero % by mass), in a case where the hardness, i.e., the hardness of the steel after the spheroidizing annealing in Examples mentioned below, satisfies the following equation (2) while the hardness after the quenching process satisfies the following equation (3), it is determined that the hardness is sufficiently low to achieve excellent cold-workability, and high hardness after the quenching process, i.e., excellent hardenability is achieved.

$$\text{Hardness (after spheroidizing annealing) (HV)} < 91([C]+[Cr]/9+[Mo]/2)+91 \quad (2)$$

$$\text{Hardness after the quenching process (HV)} > 380\ln([C])+1010 \quad (3)$$

2. Chemical Composition

The chemical composition of the steel wire for machine structural parts according to the present embodiment will be described.

[C: 0.05% by Mass to 0.60% by Mass]

C is an element that controls the strength of steel material, and the higher its content, the higher the strength of the steel after quenching and tempering. In order to effectively exhibit the above effect, the lower limit of the C content is set to 0.05% by mass. The C content is preferably 0.10% by mass or more, more preferably 0.15% by mass or more, and even more preferably 0.20% by mass or more. However, if the C content is excessive, the number of spherical cementite particles in the microstructure after the spheroidizing annealing becomes excessive, and the hardness increases, resulting in reduced cold-workability. Therefore, the upper limit of the C content is set to 0.60% by mass. The C content is preferably 0.55% by mass or less, and more preferably 0.50% by mass or less.

[Si: 0.005% by Mass to 0.50% by Mass]

Si is used as a deoxidizer during smelting and also contributes to the improvement in the strength. In order to effectively exhibit this effect, the lower limit of the Si content is set to 0.005% by mass. The Si content is preferably 0.010% by mass or more, and more preferably 0.050% by mass or more. However, Si contributes to solid solution strengthening of ferrite and has the action of considerably enhancing the strength after the spheroidizing annealing. If the Si content is excessive, the cold-workability is degraded due to the above action, and therefore the upper limit of the Si content is set to 0.50% by mass. The Si content is preferably 0.40% by mass or less, and more preferably 0.35% by mass or less.

[Mn: 0.30% by Mass to 1.20% by Mass]

Mn is an element that effectively acts as a deoxidizer and also contributes to the improvement in the hardenability. In order to sufficiently exhibit this effect, the lower limit of the Mn content is set to 0.30% by mass. The Mn content is preferably 0.35% by mass or more, and more preferably 0.40% by mass or more. However, if the Mn content is excessive, segregation occurs more easily, resulting in a reduced toughness. Thus, the upper limit of the Mn content is set to 1.20% by mass. The Mn content is preferably 1.10% by mass or less, and more preferably 1.00% by mass or less.

[P: More than 0% by Mass and 0.050% by Mass or Less]

P (phosphorus) is an inevitable impurity and a harmful element that causes the grain boundary segregation in the steel, adversely affecting forgeability and toughness. Thus, the P content is 0.050% by mass or less. The P content is preferably 0.030% by mass or less, and more preferably 0.020% by mass or less. The smaller the P content, the more preferred it is, and the P content is usually 0.001% by mass or more.

[S: More than 0% by Mass and 0.050% by Mass or Less]

S (sulfur) is an inevitable impurity that forms MnS in the steel to degrade ductility, and is thus a disadvantageous element for cold-workability. Thus, the S content is 0.050% by mass or less. The S content is preferably 0.030% by mass or less, and more preferably 0.020% by mass or less. The smaller the S content, the preferred it is, but the S content is usually 0.001% by mass or more.

[Al: 0.001% by Mass to 0.10% by Mass]

Al is an element included as a deoxidizer and has the effect of reducing impurities along with deoxidation. To exhibit this effect, the lower limit of the Al content is set to 0.001% by mass. The Al content is preferably 0.005% by mass or more, and more preferably 0.010% by mass or more. However, if the Al content is excessive, the amount of non-metallic inclusions increases, and the toughness is reduced. Thus, the upper limit of the Al content is set to 0.10% by mass. The Al content is preferably 0.08% by mass or less, and more preferably 0.05% by mass or less.

[Cr: More than 0% by Mass and 1.5% by Mass or Less]

Cr is an element that has the effect of improving the hardenability of steel and enhancing its strength, and also has the effect of promoting the spheroidizing of cementite. Specifically, Cr is solid-soluble in cementite and delays the dissolution of cementite during heating in the spheroidizing annealing. A portion of cementite remains without dissolving during heating, so that bar-shaped cementite with a large aspect ratio is less likely to be formed during cooling, making it easier to obtain a spheroidized microstructure. Therefore, the Cr content is more than 0% by mass and preferably 0.01% by mass or more. Furthermore, it may be 0.05% by mass or more, and even more 0.10% by mass or more. From the viewpoint of further promoting spheronization of cementite, the Cr content can be more than 0.30% by mass, and can be further more than 0.50% by mass. If the Cr content is excessive, the diffusion of elements containing carbon is delayed, and the dissolution of cementite is delayed more than necessary, making it difficult to obtain a spheroidized microstructure. As a result, the effect of reducing the hardness according to the present embodiment can be reduced. Thus, the Cr content is 1.50% by mass or less, preferably 1.40% by mass or less, and more preferably 1.25% by mass or less. From the viewpoint of faster diffusion of the elements, the Cr content can further be 1.00% by mass or less, 0.80% by mass or less, and even 0.30% by mass or less.

[N: More than 0% by Mass and 0.02% by Mass or Less]

N is an impurity inevitably contained in the steel, but a large content of solid solution N in the steel leads to an increase in the hardness and a decrease in ductility due to strain aging, degrading the cold-workability. Therefore, the N content is 0.02% by mass or less, preferably 0.015% by mass or less, and more preferably 0.010% by mass or less.

[Balance]

The balance is iron and inevitable impurities. As inevitable impurities, trace elements (e.g., As, Sb, Sn, etc.) brought in due to conditions of raw materials, materials, manufacturing facilities, and the like are permitted to be mixed in the steel. For example, there are elements such as P and S, which are usually preferred in smaller contents and are therefore inevitable impurities, but whose composition range is separately specified above. For this reason, the term "inevitable impurities" constituting the balance herein is based on the concept that an element whose composition range is individually specified is excluded.

The chemical composition of the steel wire for machine structural parts according to the present embodiment only needs to contain the above-mentioned elements. The selected elements mentioned below do not need to be included, but by including them together with the above elements as necessary, the hardenability and the like can be ensured more easily. The selected elements will be described below.

[One or More Selected from the Group Consisting of Cu: More than 0% by Mass and 0.25% by Mass or Less, Ni: More than 0% by Mass and 0.25% by Mass or Less, Mo: More than 0% by Mass and 0.50% by Mass or Less, and B: More than 0% by Mass and 0.01% by Mass or Less]

Cu, Ni, Mo, and B are all elements effective in increasing the strength of final products by improving the hardenability of the steel material. They may be contained alone or in combination of two or more kinds as necessary. The effects of these elements increase as their contents increase. To effectively exhibit the above effects, the preferred lower limit of the content of each of Cu, Ni, and Mo is more than 0% by mass, more preferably 0.02% by mass or more, and even more preferably 0.05% by mass or more, and the preferred lower limit of the B content is more than 0% by mass, more preferably 0.0003% by mass or more, and even more preferably 0.0005% by mass or more.

On the other hand, if the contents of these elements are excessive, the strength of the steel may become extremely high, and the cold-workability may be degraded. Thus, the preferred upper limit of each of these elements is set as mentioned above. More preferably, the content of each of Cu and Ni is 0.22% by mass or less, and even more preferably 0.20% by mass or less; the Mo content is more preferably 0.40% by mass or less, even more preferably 0.35% by mass or less; and the B content is more preferably 0.007% by mass or less, and even more preferably 0.005% by mass or less.

[One or More Selected from the Group Consisting of Ti: More than 0% by Mass and 0.2% by Mass or Less, Nb: More than 0% by Mass and 0.2% by Mass or Less, and V: More than 0% by Mass and 0.5% by Mass or Less]

Ti, Nb, and V each form a compound with N to reduce solid solution N, thereby exhibiting the effect of reducing deformation resistance. Thus, they can be contained alone or in combination of two or more kinds as necessary. The effects of these elements increase as their contents increase. To effectively exhibit the above-mentioned effects, the preferred lower limit of the content of any of these elements is more than 0% by mass, more preferably 0.03% by mass or more, and even more preferably 0.05% by mass or more. However, if the contents of these elements are excessive, the compounds formed may increase the deformation resistance, which in turn may reduce the cold-workability. Thus, the content of each of Ti and Nb is preferably 0.2% by mass or less, and the V content is preferably 0.5% by mass or less. The content of each of Ti and Nb is more preferably 0.18% by mass or less, and even more preferably 0.15% by mass or less, and the V content is more preferably 0.45% by mass or less, and even more preferably 0.40% by mass or less.

[One or More Selected from the Group Consisting of Mg: More than 0% by Mass and 0.02% by Mass or Less, Ca: More than 0% by Mass and 0.05% by Mass or Less, Li: More than 0% by Mass and 0.02% by Mass or Less, and Rare Earth Metal (REM): More than 0% by Mass and 0.05% by Mass or Less]

Mg, Ca, Li, and REM are elements effective in spheroidizing sulfide-based inclusions such as MnS and improving the deformation capacity of steel. These actions become more effective as their contents increase. To effectively exhibit the above-mentioned effects, the content of each of Mg, Ca, Li, and REM is preferably more than 0% by mass, more preferably 0.00018 by mass or more, and even more preferably 0.0005% by mass or more. However, even when their contents are excessive, their effects are already saturated, and no additional effects corresponding to their contents can be expected. Thus, the content of each of Mg and Li is preferably 0.02% by mass or less, more preferably 0.018% by mass or less, and even more preferably 0.015% by mass or less, and the content of each of Ca and REM is preferably 0.05% by mass or less, more preferably 0.045% by mass or less, and even more preferably 0.040% by mass or less. It is noted that Mg, Ca, Li and REM may be contained alone or in combination with two or more kinds. When two or more kinds of them are contained, the content of each element may be any content within the above-mentioned range. The term REM means lanthanide elements (15 elements from La to Lu), Sc (scandium) and Y (yttrium).

The shape or the like of the steel wire for machine structural parts according to the present embodiment is not particularly limited. For example, the steel wire has a diameter of 5.5 mm to 60 mm.

3. Manufacturing Method

In order to obtain the metallurgical microstructure of the steel wire for machine structural parts according to the present inventive embodiment, it is preferable to appropriately control the conditions for the spheroidizing annealing in the manufacturing of the steel wire for machine structural parts as follows. A hot rolling process for manufacturing a wire rod or steel bar to be subjected to the spheroidizing annealing is not particularly limited and can be performed by established methods. As mentioned later, wire drawing may be applied prior to the spheroidizing annealing. The diameter of the wire rod, steel wire, or steel bar, which is a bar steel to be subjected to the spheroidizing annealing, is not particularly limited. For the wire rod or steel wire, the diameter thereof is, for example, 5.5 mm to 60 mm. For the steel bar, the diameter thereof is, for example, 18 mm to 105 mm.

Referring to FIG. 1, the conditions for the spheroidizing annealing in the method for manufacturing the steel wire for machine structural parts according to the embodiment of the present invention will be described. FIG. 1 illustrates an example of a diagram for explaining the conditions for the spheroidizing annealing in the manufacturing method according to the embodiment of the present invention. The number of times of repetition of the cooling-heating process is not limited to that shown in FIG. 1.

The method for manufacturing the steel wire for machine structural parts according to the embodiment of the present invention includes the spheroidizing annealing process including the following processes (1) to (3):

(1) heating the steel to a temperature T1 of (A1+8° C.) or higher, and then heating and holding the steel at the temperature T1 for more than 1 hour and 6 hours or less;

(2) performing a cooling-heating process two to six times in total, wherein the cooling-heating process includes cooling the steel to a temperature T2 of higher than 650° C. and (A1−17° C.) or lower at an average cooling rate R1 of 10° C./hour to 30° C./hour, and then heating the steel to a heating temperature of higher than the temperature T2 and (A1+60° C.) or lower; and (3) cooling the steel from the heating temperature of the final cooling-heating process, where A1 is calculated by the following equation (1):

$$A1(°\ C.)=723+29.1\times[Si]-10.7\times[Mn]+16.9\times[Cr]-16.9\times[Ni] \quad (1)$$

where an expression [element] represents the content of each element (% by mass), and the content of an element not contained is zero.

[(1) Heating the Steel to the Temperature T1 of (A1+8° C.) or Higher, and then Heating and Holding the Steel at the Temperature T1 for More than 1 Hour and 6 Hours or Less ([2] of FIG. 1)]

By heating to the temperature T1 of (A1+8° C.) or higher, the dissolution of bar-shaped cementite with a large aspect ratio, which has been formed during the rolling stage, is promoted. If the temperature T1 is extremely low, the bar-shaped cementite is not dissolved during heating and holding and continues to remain in ferrite, increasing the hardness of the steel. To obtain sufficiently softened steel wires, the temperature T1 needs to be set to (A1+8° C.) or higher. The temperature T1 is preferably (A1+15° C.) or higher, and more preferably (A1+20° C.) or higher. On the other hand, to sufficiently suppress excessive coarsening of crystal grains, to precipitate spherical cementite more easily at the ferrite grain boundaries during the subsequent cooling process, and to suppress the amount of remaining bar-shaped cementite to reduce the hardness more easily, the temperature T1 is preferably set to (A1+57° C.) or lower.

If the heat holding time (t1) is extremely short, bar-shaped cementite remains in the ferrite grains, and the hardness increases. To obtain sufficiently softened steel wires, the heat holding time (t1) needs to be more than 1 hour and 6 hours or less. The preferred heat holding time (t1) is 1.5 hours or more, and more preferably 2.0 hours or more. If the heat holding time (t1) is extremely long, the heat treatment time becomes longer, thus reducing the productivity. Thus, the heat holding time (t1) is 6 hours or less, preferably 5 hours or less, and more preferably 4 hours or less. The average temperature increase rate during heating to the temperature T1 of (A1+8° C.) or higher ([1] of FIG. 1) does not affect steel properties, and thus the temperature of the steel material can be increased at any rate. For example, the temperature may be increased at 30° C./hour to 100° C./hour.

It is noted that the temperature at the above-mentioned A1 point is calculated by the following equation (1) mentioned on p. 273, Leslie, W. C. The Physical Metallurgy of Steels (Maruzen).

$$A1(°\ C.)=723+29.1\times[Si]-10.7\times[Mn]+16.9\times[Cr]-16.9\times[Ni] \quad (1)$$

where an expression [element] represents the content of each element (% by mass), and the content of an element not contained is zero.

[(2) Performing a Cooling-Heating Process Two to Six Times in Total, Wherein the Cooling-Heating Process Includes Cooling the Steel to a Temperature T2 of Higher than 650° C. and (A1−17° C.) or Lower at an Average Cooling Rate R1 of 10° C./Hour to 30° C./Hour, and then Heating the Steel to a Heating Temperature of Higher than the Temperature T2 and (A1+60° C.) or Lower ([3] to [7] of FIG. 1)]

(2-i) Cooling the Steel to a Temperature T2 of Higher than 650° C. to (A1−17° C.) at an Average Cooling Rate R1 of 10° C./Hour to 30° C./Hour ([3] and [4] in FIG. 1)

The steel is cooled to precipitate spheroidal cementite on the ferrite grain boundaries. If the average cooling rate R1 from the temperature T1 is extremely fast, an excessive amount of bar-shaped cementite is reprecipitated, and the cold-workability is reduced. Thus, the average cooling rate R1 is set to 30° C./hour or lower. The average cooling rate R1 is preferably 25° C./hour or less, and more preferably 20° C./hour or lower. On the other hand, if the average cooling rate R1 is extremely slow, the cementite formed during cooling becomes excessively coarse, and as a result, the cementite is not sufficiently dissolved while the high temperature is held in the quenching process, leading to lower hardness after the quenching process, i.e., degradation in the hardenability. Furthermore, annealing time is prolonged, resulting in lower productivity. Therefore, the average cooling rate R1 is 10° C./hour or more, preferably 11° C./hour or more, and more preferably 12° C./hour or more.

If the ultimate temperature T2 of the cooling at the average cooling rate R1 is extremely low, the annealing time is prolonged. Therefore, the ultimate temperature T2 of the cooling needs to be higher than 650° C. According to the manufacturing method of the present embodiment, even when the ultimate temperature T2 of the cooling is higher than 650° C., cementite can be controlled to have the desired form without performing the annealing for a long time. The ultimate temperature T2 of the cooling is preferably 670° C. or higher. On the other hand, if the ultimate temperature T2 of the cooling is extremely high, an excessive amount of bar-shaped cementite is reprecipitated in the ferrite grains, resulting in increased hardness and reduced cold-workability. Therefore, the upper limit of the ultimate temperature T2 of the cooling is set to A1−17° C. The ultimate temperature T2 of the cooling is preferably A1−18° C. or lower. In addition, if the ultimate temperature T2 of the cooling is reached and then held, this leads to a longer heat treatment time. Therefore, from these viewpoints, the temperature T2 should not be held. However, it may be held only for a short time so as to make variations in the temperature of the inside of a furnace uniform. The holding time (t2) at the ultimate temperature T2 of the cooling is preferably 1 hour or less.

(2-ii) Heating the Steel to a Heating Temperature Higher than the Temperature T2 and (A1+60° C.) or Lower ([5] and [6] in FIG. 1)

In order to redissolve the bar-shaped cementite precipitated in the ferrite grains in the above-mentioned process (2-i), heating is started from the ultimate temperature T2 of the cooling. An ultimate temperature of heating such as that indicated by [6] of FIG. 1, i.e., the heating temperature, can be any temperature in the temperature range higher than the temperature T2 and (A1+60° C.) or lower. The heating temperature is preferably A1° C. or higher from the viewpoint of sufficiently redissolving the bar-shaped cementite formed in the process (2-i). From the viewpoint of suppressing the redissolution of spheroidal cementite on the ferrite grain boundaries and suppressing an increase in the hardness of the steel after the spheroidizing annealing, the heating temperature is preferably (A1+57° C.) or lower.

The average temperature increase rate when increasing the temperature from the ultimate temperature T2 of the cooling to the heating temperature, such as that indicated by [5] of FIG. 1, is also not particularly limited. The average temperature increase rate may be, for example, 200° C./hour or lower from the viewpoint of more sufficiently redissolving the bar-shaped cementite in the ferrite grains formed in the process (2-i) and further suppressing the hardness of the steel after the spheroidizing annealing. For example, the average temperature increase rate may be set to 5° C./hour or higher from the viewpoint of sufficiently suppressing the coarsening of cementite formed by this heating and further enhancing the hardenability.

It does not matter whether or not the heating temperature is held after the above heating temperature is reached. In the case of holding this heating temperature, for example, the holding time is set to one hour or less to suppress the redissolution of spherical cementite on the ferrite grain boundaries.

In the manufacturing method according to the present embodiment, the cooling-heating process of the cooling in the process (2-i) and the heating in this process (2-ii) is repeated a plurality of times, and in each time, the average cooling rate R1 and the temperature T2 need to satisfy the above ranges.

The magnitude relationship between the above heating temperature and the temperature T1 is not particularly limited. For example, the heating temperature may be the same temperature as the above temperature T1, or the heating temperature may be higher than the above temperature T1.

(2-iii) Performing a Cooling-Heating Process Two to Six Times in Total ([7] of FIG. 1)

To increase the proportion of cementite present at the ferrite grain boundaries and to promote the coarsening of cementite present at the ferrite grain boundaries, the cooling-heating process of the above-mentioned processes (2-i) and (2-ii) needs to be performed two or more times in total after heating and holding at the temperature T1 in the process (1). If this cooling-heating process is not repeated, the proportion of cementite present at the ferrite grain boundaries becomes insufficient, or the coarsening of cementite present at the ferrite grain boundaries becomes insufficient, whereby the hardness of the steel after the spheroidizing annealing increases. Thus, the above cooling-heating process is performed two or more times. Preferably, it is performed three or more times. The more times the process is performed, the lower the hardness becomes, but if the process is performed extremely many times, its effect is saturated. In addition, this leads to a longer annealing time, resulting in lower productivity. Therefore, the number of times the cooling-heating process is performed is limited to six or less. In the case of FIG. 1, the number of times the cooling-heating process in the above-mentioned processes (2-i) and (2-ii) is performed is four. The ultimate temperature T2 of the cooling and the average cooling rate R1 of each cooling may be different within their specified ranges. The average cooling rate R1 refers to the average cooling rate from the temperature T1 to the ultimate temperature T2 of the cooling in the first cooling-heating process, and refers to the average cooling rate from the heating temperature indicated by [6] of FIG. 1 to the ultimate temperature T2 of the cooling in the second and subsequent cooling-heating processes.

[(3) Cooling the Steel from the Heating Temperature of the Final Cooling-Heating Process ([8] of FIG. 1)]

The steel is cooled from the heating temperature of the final cooling-heating process. The average cooling rate and the ultimate cooling temperature during the cooling are not particularly limited. From the viewpoint of further suppressing the reprecipitation of bar-shaped cementite, the average cooling rate may be set to 100° C./hour or lower, for example. The average cooling rate may be set to 5° C./hour or higher from the viewpoint of further suppressing excessive coarsening of cementite. The ultimate cooling temperature can be, for example, (A1−30° C.) or lower. For example, the steel may be cooled at the above average cooling rate to a temperature range of (A1−30° C.) or lower and (A1−100° C.) or higher, followed by air cooling. Alternatively, for example, the ultimate cooling temperature may be set to lower than (A1−100° C.) to further suppress the reprecipitation of the bar-shaped cementite and further enhance the cold-workability. In this case, from the viewpoint of shortening the annealing time, the ultimate cooling temperature may be (A1−250° C.) or higher, further (A1−200° C.) or higher, or even (A1−150° C.) or higher.

The above-mentioned spheroidizing annealing (processes (1) to (3)) may be repeated one or more times. From the viewpoint of preventing excessive coarsening of cementite and ensuring productivity, the annealing is preferably performed four times or less, and more preferably three times or less. When the above-mentioned spheroidizing annealing is repeated a plurality of times, it may be repeated on the same conditions or under different conditions within the above specified range. When the above-mentioned spheroidizing annealing is repeated a plurality of times, wire drawing may be added between the spheroidizing annealing processes. For example, wire drawing prior to the spheroidizing annealing, which is mentioned later, →first spheroidizing annealing→wire drawing→second spheroidizing annealing can be performed in this order.

In the method for manufacturing the steel wire for machine structural parts according to the present embodiment, processes other than the spheroidizing annealing process are not particularly limited. For example, after the spheroidizing annealing, performing wire drawing at an area reduction ratio of preferably 15% or less may be included for the purpose of adjusting dimensions. By setting the area reduction ratio to 15% or less, the increase in the hardness prior to the cold-working can be suppressed. The area reduction ratio is more preferably 10% or less, further preferably 8% or less, and even more preferably 5% or less.

To promote the formation of the microstructure form of the present invention, subjecting the wire rod to wire drawing at the area reduction ratio of more than 5% prior to the spheroidizing annealing is preferably included. By performing the wire drawing at the above-mentioned area reduction ratio, the cementite in the steel is broken down, and the aggregation of cementite in the subsequent spheroidizing annealing process can be promoted, so that cementite can be appropriately coarsened, which is effective in softening the steel. The area reduction ratio is more preferably 10% or more, further preferably 15% or more, and even more preferably 20% or more. On the other hand, an excessive area reduction ratio can cause a risk of wire breakage. Thus, the area reduction ratio is preferably set to 50% or less. In the case of performing the wire drawing a plurality of times, the number of execution of wire drawing is not particularly limited, and can be, for example, two. When the wire drawing is performed a plurality of times, the term "area reduction ratio during the wire drawing" means the area reduction ratio of a steel material obtained after the wire drawing is repeated a plurality of times to the steel material prior to the wire drawing.

Examples

Hereinafter, the present disclosure will be described more specifically by way of Examples. The present disclosure is not limited by the following Examples, but obviously it may also be implemented with modifications as appropriate to the extent that the modifications conform to the above-mentioned and following concepts, and all of these modifications are included in the technical scope of the present disclosure.

After specimens with the chemical compositions shown in Table 1 were smelted in a converter furnace, steel pieces obtained by casting were hot-rolled, thereby manufacturing wire rods with diameters of 12 to 16 mm. In Table 2 mentioned later, in the case of "presence" of the wire drawing prior to the spheroidizing annealing, i.e., in sample No. 2 as shown in Table 3 which was manufactured under the manufacturing conditions B, a steel wire obtained by wire drawing of the wire rod at the area reduction ratio of 25% was subjected to spheroidizing annealing.

The above wire rod or steel wire was used and annealed using a laboratory furnace. In the annealing, the wire rod or steel wire had its temperature increased up to T1 shown in Table 2 and held for t1 hours. The wire rod or steel wire was then cooled to the temperature T2 in Table 2 at the average cooling rate R1 in Table 2, and subsequently heated to a heating temperature of higher than T2 in Table 2 and (A1+60° C.) or lower. This cooling-heating process was performed the number of times of execution of the cooling-heating process as shown in Table 2. Then cooling from the heating temperature of the final cooling-heating process was performed to produce a sample.

Figure 2:
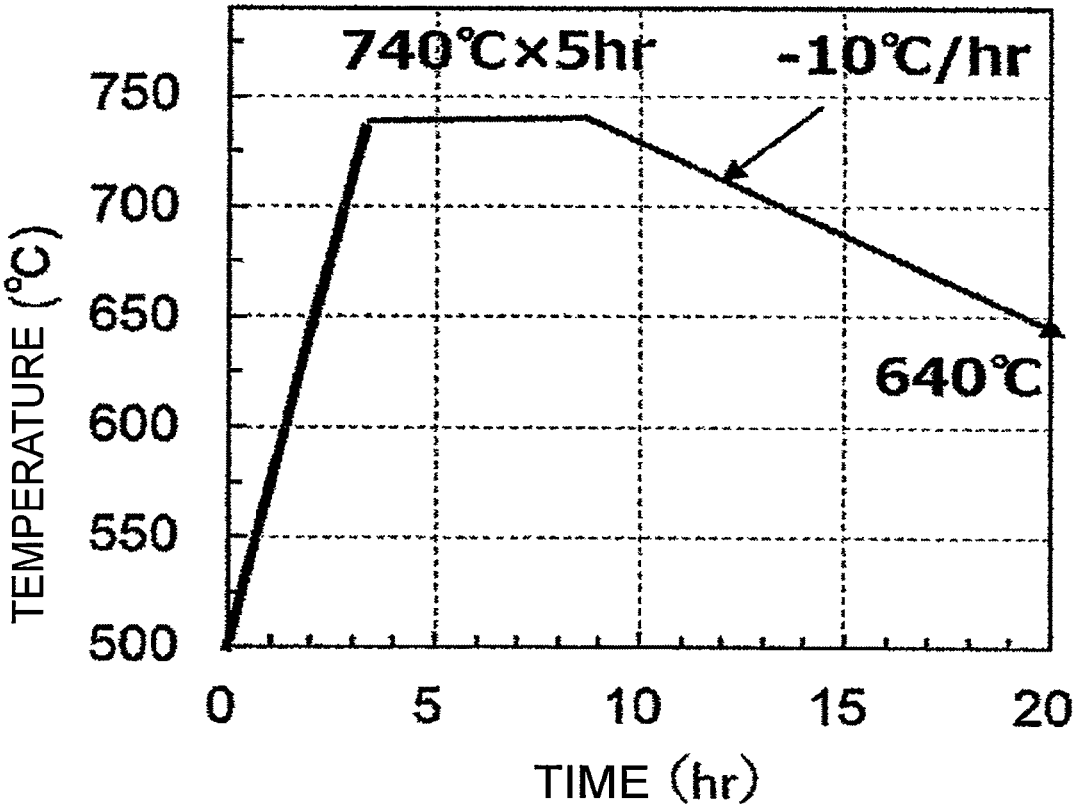
FIG. 2 is a diagram for explaining a heat treatment process of Comparative Example.

As Comparative Example, sample No. 14 shown in Table 3 was obtained under a manufacturing condition J1, in which a heat treatment process shown in FIG. 2, i.e., a heat treatment process with no cooling-heating process was performed. Under this manufacturing condition J1, the wire drawing at the area reduction ratio of 25% was not performed prior to annealing. Sample No. 15 shown in Table 3 was obtained under a manufacturing condition J2, in which a steel wire was obtained by wire drawing at the area reduction ratio of 25% prior to the annealing and then the steel wire obtained was used and subjected to the heat treatment process shown in FIG. 2, i.e., a heat treatment process with no cooling-heating process was performed.

Figure 3:
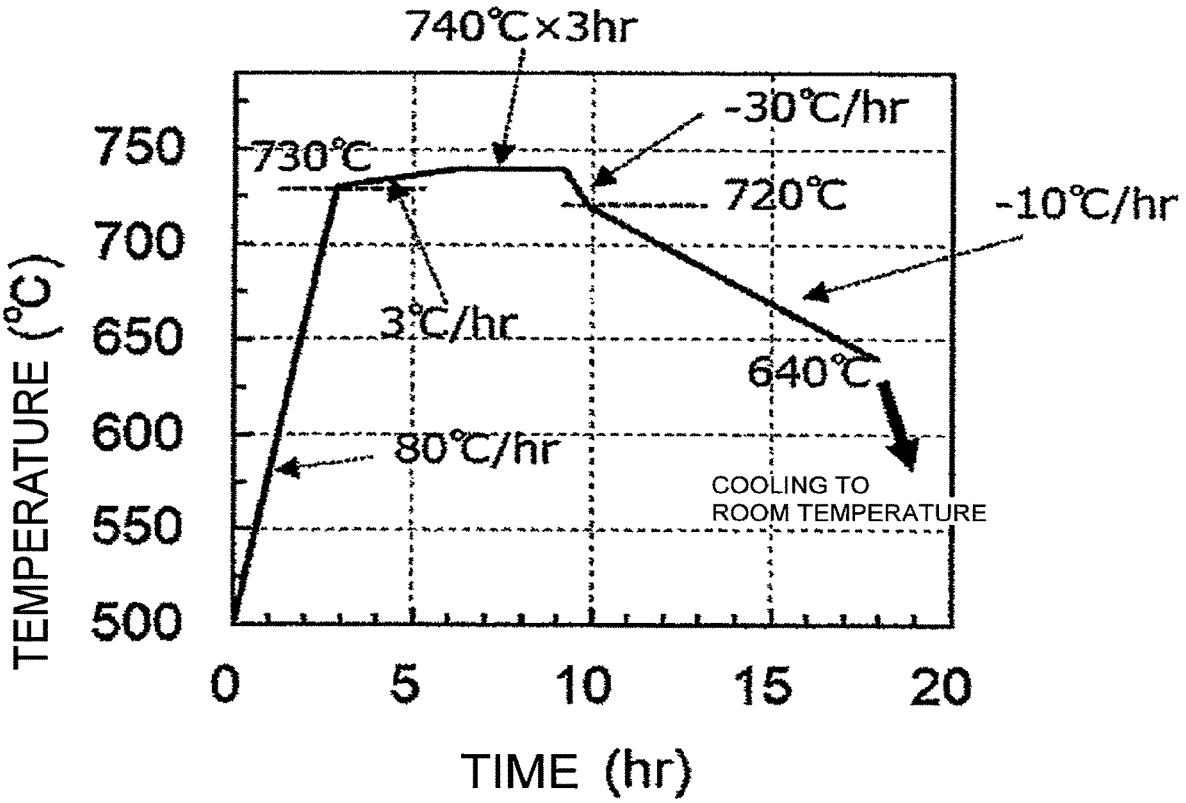
FIG. 3 is a diagram for explaining a heat treatment process in the prior art.
Figure 4:
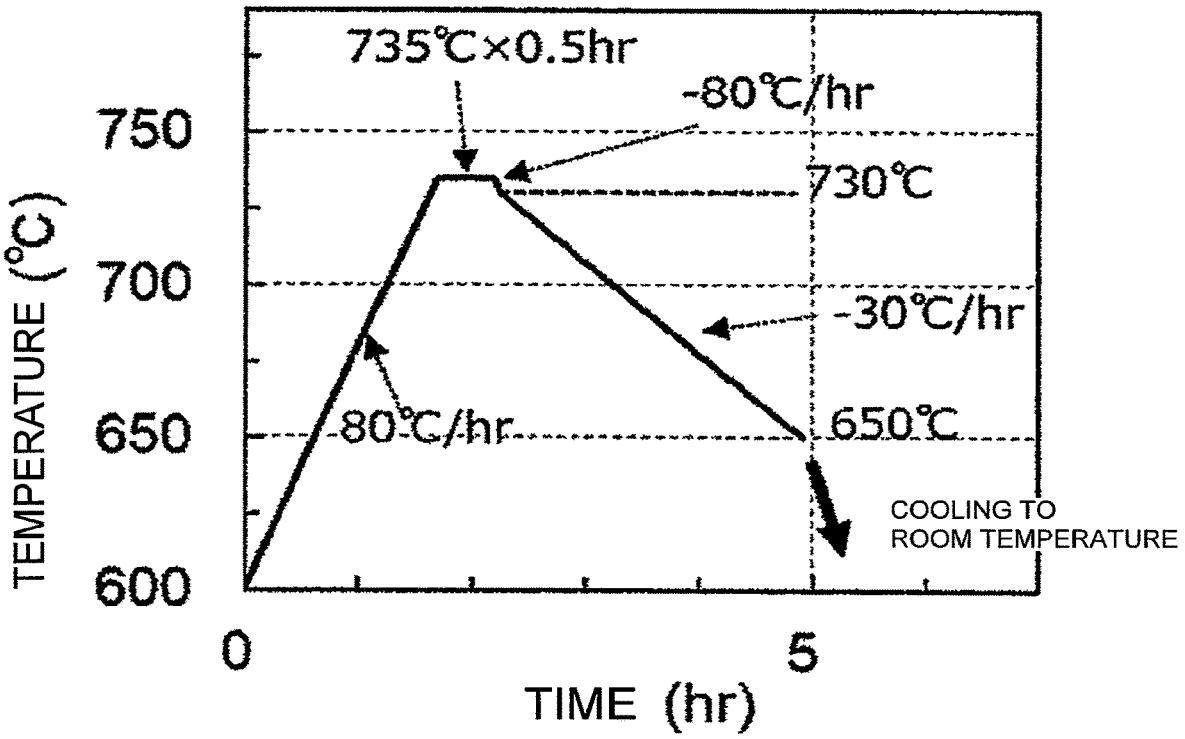
FIG. 4 is a diagram for explaining a heat treatment process in another prior art.
Figure 5:
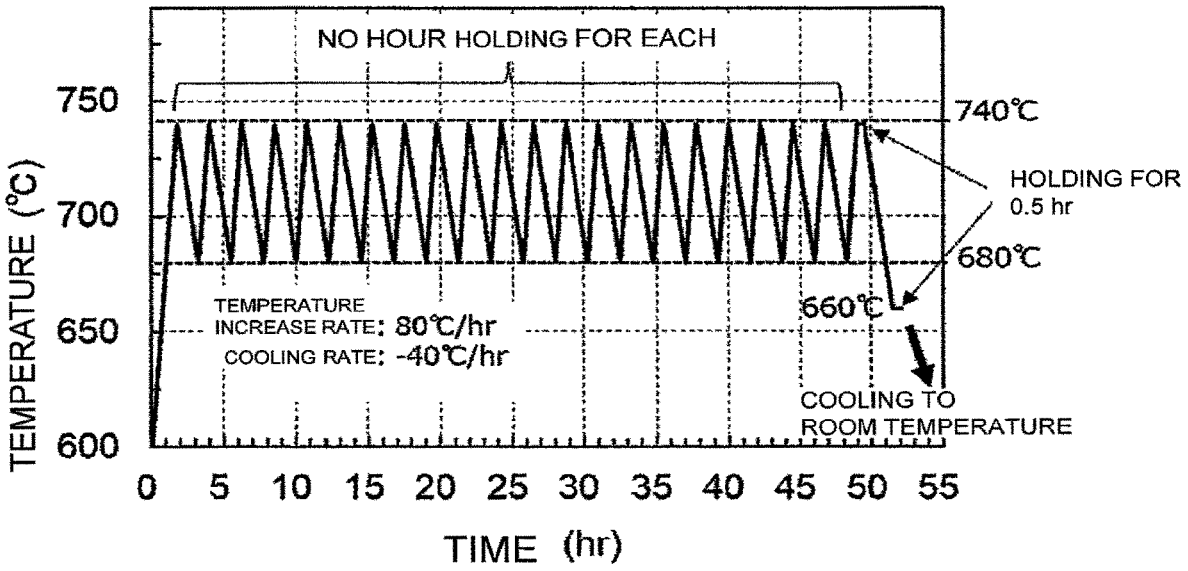
FIG. 5 is a diagram for explaining a heat treatment process in another prior art.

As another Comparative Example, sample No. 16 shown in Table 3 was obtained under a manufacturing condition K, in which a heat treatment process was performed under heat treatment conditions satisfying the manufacturing conditions of Patent Document 3, in detail, under the conditions indicated as SA2 in an example of Patent Document 3, that means, the heat treatment process shown in FIG. 3 was repeated five time. Sample No. 20 shown in Table 3 was obtained under a manufacturing condition O, in which a heat treatment process was performed under heat treatment conditions satisfying the manufacturing conditions of Patent Document 1, in detail, under the fifth spheroidizing annealing conditions in No. 1 of Table 2 in Patent Document 1, that means, the heat treatment process shown in FIG. 4 was repeated three time. Sample No. 21 shown in Table 3 was obtained under a manufacturing condition P, in which a heat treatment process under heat treatment conditions satisfying the manufacturing conditions of Patent Document 2, in detail, under conditions c shown in Table 2 of Patent Document 2, that means, a heat treatment process with a pattern shown in FIG. 5. T1 and T2, which were annealing parameters described in Table 2, were the set temperatures of the heat treatment furnace. The deviation between the actual temperature of the steel material and the set temperature was tested by attaching thermocouples to the steel material, and it was confirmed that the temperature of the steel material was substantially the same as the set temperature.

Using the samples obtained by the above annealing process, the average ferrite grain size, the average size of all the cementite, and the grain boundary cementite ratio were determined in the following ways as evaluation items of the metallurgical microstructure. In addition, as the properties, the hardness after the spheroidizing annealing and the hardness after the quenching process were measured and evaluated by the following methods.

[Evaluation of Metallurgical Microstructure]

[Average Ferrite Grain Size]

First, the ferrite grain size number was measured as follows. A test piece was embedded in resin such that the D/4 position (D: diameter of a steel wire) of the cross-section of the steel wire after the spheroidizing annealing, i.e., the section perpendicular to the axial direction of the steel wire, could be observed, and the above test piece was etched using nital (2% by volume nitric acid and 98% by volume ethanol) as a corrosion solution to expose its microstructure. The above exposed microstructure of the test piece was observed with an optical microscope at a magnification of 400 times, and one field of view where ferrite crystal grains of an average size, representative of the microstructure of the entire steel wire, could be observed was selected in an evaluation plane, whereby its micrograph was obtained. The value of the ferrite grain size number (G) was then calculated based on a comparison method of JIS G0551 (2020) from the micrographs taken. Subsequently, by using the calculated value of the ferrite grain size number (G), an average ferrite grain size dn was determined from the following equation (4), wherein the equation shows the relationship between the average ferrite grain size dn and the ferrite grain size number G (orN) among the relationships between various quantities regarding the grain size number and grain size, described in Table 1 on p. 32 of "Introductory Course Technical Terms—Iron and Steel Materials Edition-3: Grain Size Numbers and Grain Sizes," Minoru Umemoto, Ferrum Vol. 2 (1997) No. 10, pp. 29-34. The results are shown in Table 3. It is noted that in the present examples, the samples No. 1 to 13 in Table 3 all had an area ratio of ferrite of 90% or more.

$$dn=0.254/(2^{(G-1)/2}) \quad (4)$$

[Average Size of all the Cementite, and Grain Boundary Cementite Ratio]

To measure the average size of all the cementite and the grain boundary cementite ratio of the steel wire after the spheroidizing annealing, a test piece was embedded in resin such that the cross-section of the steel wire could be observed, followed by cutting, and a cut surface of the test piece was mirror polished by emery paper and diamond buffing. The cut surface was then etched for 30 seconds to 1 minute using nital (2% by volume nitric acid and 98% by volume ethanol) as the corrosion solution to expose the ferrite grain boundaries and cementite at the D/4 position (D: diameter of the steel wire). Subsequently, the microstructure of the test piece with the above-mentioned cementite, etc. being exposed was observed using a field-emission scanning electron microscope (FE-SEM), and three fields of view were taken at a magnification of 2, 500 times.

An OHP film was superimposed on the micrograph taken above, and the cementite present at the ferrite grain boundaries shown in the micrograph was filled in on the OHP film to thereby obtain a first projected image for the analysis of the grain boundary cementite. The term "cementite present at the ferrite grain boundaries" includes both cementite in contact with the ferrite grain boundaries and cementite present on the ferrite grain boundaries, as described above.

Thereafter, the cementite present in the ferrite grains was further filled in on the OHP film to thereby obtain a second projected image for analysis of all the cementite.

The first projected image was binarized to form a black-and-white photograph, and the grain boundary cementite ratio was calculated using an image analysis software "Particle Analysis Ver. 3.5" (manufactured by NIPPON STEEL TECHNOLOGY Co., Ltd.). The second projected image was also binarized to form a black-and-white photograph, and the circular-equivalent diameter of all the cementite was calculated using the above-mentioned image analysis software. It is noted that the average size of all the cementite and the grain boundary cementite ratio mentioned in Table 3 are the average values calculated from the three fields of view.

The minimum size (circular-equivalent diameter) of cementite to be measured was 0.3 μm. Regarding cementite composed of cementite particles with an aspect ratio of more than 3.0, their cementite particles invade not only the ferrite grain boundaries, but also the inside of the ferrite grains even when contacting the ferrite grain boundaries, and thus it is thought that such cemetite has the same influence as cementite present in the ferrite grains. Therefore, such cementite was determined to be "cementite in the ferrite grains". It is noted that the aspect ratio as used herein is the ratio (major diameter/minor diameter) of the longest length of a cementite particle, the major diameter, to the longest length thereof in the direction perpendicular to the major diameter, the minor diameter.

[Evaluation of Properties]

[Measurement of Hardness after Spheroidization Annealing]

To evaluate the cold-workability, the hardness of each sample obtained after the spheroidizing annealing was measured as follows. The Vickers hardness test was conducted on a test piece in accordance with JIS Z2244 (2009) at the D/4 position (D: diameter of the steel wire) of the cross section of the test piece, i.e., the section perpendicular to the rolling direction. The Vickers hardness obtained by calculating the average hardness at three or more points on the sample was defined as the hardness after the spheroidizing annealing. The measurement results are shown in Table 3. In Table 3, "spheroidizing hardness" is defined as the hardness after the spheroidizing annealing. In the present example, when the C content (% by mass), Cr content (% by mass), and Mo content (% by mass) of the steel are expressed as [C], [Cr], and [Mo], respectively (elements not included are assumed to be zero % by mass), the steel was evaluated as "OK" because of excellent cold-workability in a case where its hardness after the spheroidizing annealing satisfied the equation (2) below, whereas the steel was evaluated as "NG" because of inferior cold-workability in a case where its hardness after the spheroidizing annealing did not satisfy the equation (2) below.

$$\text{Hardness (HV) after the spheroidizing annealing} < 91([C]+[Cr]/9+[Mo]/2)+91 \quad (2)$$

[Measurement of Hardness After the Quenching Process]

To evaluate the hardenability, the hardness of each sample obtained after the spheroidizing annealing was measured as follows. First, in order to perform sufficient hardening in the quenching process, each sample obtained after the spheroidizing annealing was processed to have a thickness (t) of 5 mm, which was the length in the rolling direction, and it was then prepared as a specimen for quenching treatment. The specimen was held at a high temperature of A3+(30 to 50° C.) for 5 minutes in the quenching process, and was then water-cooled after the high temperature was held. The A3 is a value derived from the following equation (5). The high-temperature holding time here was defined as the time that elapses after the furnace temperature reached the set temperature.

$$A3(°\,C.)=910-203\times\sqrt{([C])}-14.2\times[Ni]+44.7\times[Si]+104\times[V]+31.5\times[Mo]+13.1\times[W]-30\times[Mn]-11\times[Cr]-20\times[Cu]+700\times[P]+400\times[Al]+120\times[As]+400\times[Ti] \quad (5)$$

where an expression [element] represents the content of each element (% by mass), and the content of an element not included is calculated as 0%.

The Vickers hardness test was conducted on the specimen, obtained after the quenching process, at a t/2 and D/4 position (D: diameter of the steel wire, t: thickness of the sample) of the specimen. The Vickers hardness obtained by calculating an average value of the hardnesses at three or more points on the specimen was defined as the hardness after the quenching process. The measurement results are shown in Table 3. In Table 3, the hardness after the quenching process was referred to as the "quenching hardness". In the present example, when the C content (% by mass) of the steel is expressed as [C], the steel was evaluated as "OK" because of excellent hardenability in a case where its hardness after the quenching process satisfied the equation (3) below, whereas the steel was evaluated as "NG" because of inferior hardenability in a case where its hardness after the quenching process did not satisfy the equation (3) below.

$$\text{Hardness (HV) after the quenching process} > 380\ln([C])+1010 \quad (3)$$

In Table 3, when both the hardness after the spheroidizing annealing and the hardness after the quenching process were OK, the overall judgment was made "OK" because the steel had both excellent cold-workability and excellent hardenability. When at least one of the hardness after the spheroidizing annealing and the hardness after the quenching process was NG, the overall judgment was made "NG" because the steel could not achieve both excellent cold-workability and excellent hardenability. In Tables 2 and 3, underlined values indicate that they deviated from the specified range of the present disclosure or did not meet the desired properties.

TABLE 1

| Steel | Chemical composition (% by mass, balance: iron and inevitable impurities) | | | | | | | | | |
|---|---|---|---|---|---|---|---|---|---|---|
| type | C | Si | Mn | P | S | Cr | Mo | Al | N | A1 |
| I | 0.45 | 0.19 | 0.71 | 0.011 | 0.004 | 0.15 | 0.01 | 0.035 | 0.0049 | 723 |
| II | 0.35 | 0.18 | 0.76 | 0.008 | 0.014 | 0.03 | 0.00 | 0.029 | 0.0053 | 720 |
| III | 0.26 | 0.18 | 0.45 | 0.009 | 0.004 | 0.02 | 0.00 | 0.036 | 0.0053 | 724 |
| IV | 0.15 | 0.17 | 0.42 | 0.014 | 0.006 | 0.04 | 0.01 | 0.032 | 0.0051 | 724 |

TABLE 1-continued

| Steel type | Chemical composition (% by mass, balance: iron and inevitable impurities) C | Si | Mn | P | S | Cr | Mo | Al | N | A1 |
|---|---|---|---|---|---|---|---|---|---|---|
| V | 0.20 | 0.18 | 0.84 | 0.013 | 0.017 | 1.18 | 0.01 | 0.023 | 0.0127 | 739 |
| VI | 0.21 | 0.18 | 0.78 | 0.018 | 0.015 | 1.14 | 0.16 | 0.028 | 0.0160 | 739 |

TABLE 2

| Manufacturing condition symbol | Wire drawing prior to spheroidizing annealing | T1 (° C.) | t1 (h) | R1 (° C./h) | T2 (° C.) | Number of times of execution of cooling-heating process |
|---|---|---|---|---|---|---|
| A | Absence | 750 | 2 | 30 | 690 | 4 |
| B | Presence | 750 | 2 | 30 | 700 | 4 |
| C | Absence | 735 | 2 | 30 | 675 | 4 |
| D | Absence | 740 | 2 | 16 | 690 | 6 |
| E | Absence | 750 | 2 | 12 | 690 | 4 |
| F | Absence | 750 | 2 | 13 | 690 | 4 |
| G | Absence | 750 | 2 | 30 | 705 | 4 |
| H | Absence | 750 | 2 | 30 | 690 | 2 |
| I | Absence | 750 | 2 | 16 | 690 | 2 |
| T | Absence | 765 | 2 | 26 | 705 | 3 |

TABLE 2-continued

| Manufacturing condition symbol | Wire drawing prior to spheroidizing annealing | T1 (° C.) | t1 (h) | R1 (° C./h) | T2 (° C.) | Number of times of execution of cooling-heating process |
|---|---|---|---|---|---|---|
| L | Absence | 730 | 2 | 16 | 690 | 6 |
| M | Absence | 750 | 2 | 30 | 710 | 4 |
| N | Absence | 750 | 2 | 9 | 690 | 6 |
| Q | Absence | 750 | 2 | 30 | 690 | 1 |
| R | Absence | 750 | 2 | 16 | 690 | 1 |
| S | Absence | 730 | 2 | 30 | 690 | 4 |
| W | Absence | 765 | 2 | 10 | 690 | 0 |
| X | Absence | 765 | 2 | 16 | 690 | 0 |
| Y | Absence | 770 | 2 | 10 | 690 | 0 |

TABLE 3

| Sample no. | Steel type | Manufacturing condition symbol | Microstructure: Average ferrite grain size (μm) | Average size of all the cementite (um) | Grain boundary cementite ratio (area %) | Properties: Spheroidizing hardness (HV) | Quenching hardness (HV) | Judgement: Spheroidizing hardness | Quenching hardness | Overall judgement |
|---|---|---|---|---|---|---|---|---|---|---|
| 1 | I | A | 15.88 | 0.812 | 54 | 131 | 744 | OK | OK | OK |
| 2 | I | B | 10.12 | 0.839 | 62 | 128 | 746 | OK | OK | OK |
| 3 | I | D | 13.35 | 0.736 | 54 | 132 | 714 | OK | OK | OK |
| 4 | I | E | 10.12 | 0.823 | 48 | 131 | 745 | OK | OK | OK |
| 5 | I | F | 12.03 | 0.782 | 46 | 133 | 737 | OK | OK | OK |
| 6 | I | G | 10.12 | 0.830 | 50 | 131 | 736 | OK | OK | OK |
| 7 | I | H | 12.03 | 0.732 | 49 | 132 | 732 | OK | OK | OK |
| 8 | I | I | 11.23 | 0.783 | 52 | 129 | 739 | OK | OK | OK |
| 9 | II | C | 15.88 | 0.923 | 64 | 118 | 768 | OK | OK | OK |
| 10 | III | A | 15.88 | 1.301 | 83 | 111 | 508 | OK | OK | OK |
| 11 | IV | A | 15.88 | 1.378 | 96 | 105 | 440 | OK | OK | OK |
| 12 | V | T | 22.45 | 1.300 | 41.3 | 119 | 419 | OK | OK | OK |
| 13 | VI | T | 20.95 | 1.240 | 32.3 | 124 | 425 | OK | OK | OK |
| 14 | I | J1 | 11.23 | 0.716 | 31 | 146 | 736 | NG | OK | NG |
| 15 | I | J2 | 11.23 | 0.645 | 51 | 136 | 724 | NG | OK | NG |
| 16 | I | K | 11.23 | 0.906 | 59 | 128 | 706 | OK | NG | NG |
| 17 | I | L | 10.12 | 0.560 | 47 | 142 | 723 | NG | OK | NG |
| 18 | I | M | 10.12 | 0.696 | 36 | 144 | 729 | NG | OK | NG |
| 19 | I | N | 11.23 | 1.028 | 72 | 126 | 693 | OK | NG | NG |
| 20 | I | O | 11.23 | 0.577 | 39 | 140 | 721 | NG | OK | NG |
| 21 | I | P | 10.12 | 0.702 | 51 | 134 | 727 | NG | OK | NG |
| 22 | I | Q | 10.12 | 0.670 | 40 | 138 | 711 | NG | OK | NG |
| 23 | I | R | 12.03 | 0.708 | 41 | 135 | 727 | NG | OK | NG |
| 24 | I | S | 11.23 | 0.585 | 35 | 143 | 759 | NG | OK | NG |
| 25 | II | J1 | 10.12 | 0.785 | 60 | 133 | 779 | NG | OK | NG |
| 26 | III | J1 | 14.31 | 1.110 | 81 | 129 | 531 | NG | OK | NG |
| 27 | IV | J1 | 15.88 | 1.130 | 85 | 106 | 407 | NG | OK | NG |
| 28 | V | W | 22.45 | 1.100 | 26.6 | 125 | 432 | NG | OK | NG |
| 29 | V | Y | 26.70 | 1.160 | 22.5 | 124 | 415 | NG | OK | NG |
| 30 | VI | X | 17.01 | 1.120 | 29.6 | 133 | 454 | NG | OK | NG |
| 31 | VI | Y | 18.88 | 1.120 | 33.2 | 134 | 452 | NG | OK | NG |

The results in the table will be discussed. The following No. refers to sample No. in Table 3. Nos. 1 to 13 are inventive examples satisfying all of the composition, metallurgical microstructure, and spheroidizing annealing conditions specified by the embodiment of the present invention.

No. 14 was not subjected to any cooling-heating process, resulting in low grain boundary cementite ratio, higher hardness after the spheroidizing annealing than the reference value, and inferior cold-workability.

No. 15 was an example of performing annealing after wire drawing at an area reduction ratio of 25%, and this wire drawing could increase the grain boundary cementite ratio. However, no cooling-heating process was performed, and thus the average size of all the cementite could not be at a certain level or more, resulting in higher hardness after the spheroidizing annealing than the reference value and inferior cold-workability.

No. 16 is an example where annealing was performed under the annealing condition SA2 of Patent Document 3 as the manufacturing condition K that satisfied the manufacturing conditions shown in Patent Document 3. Under this manufacturing condition, the annealing excessively coarsens cementite, causing the hardness after the quenching process to become lower than the reference value, resulting in inferior hardenability.

In No. 17 and No. 24, the temperature T1 was 730° C., which was lower than (A1+8° C.). Thus, a large amount of bar-shaped cementite of a small size remained in crystal grains, resulting in the average size of all the cementite being not larger than or equal to the certain level, higher hardness after the spheroidizing annealing than the reference value, and inferior cold-workability.

In No. 18, since the ultimate temperature T2 of cooling at the average cooling rate R1 was set to 710° C., which was higher than (A1−17° C.), the coarsening of cementite during the cooling became insufficient, resulting in the average size of all the cementite being not larger than or equal to the certain level, higher hardness after the spheroidizing annealing than the reference value, and inferior cold-workability.

In No. 19, the average cooling rate R1 was 9° C./hour, which was slow. Thus, cementite was excessively coarsened, resulting in higher average size of all the cementite, lower hardness after the quenching process than the reference value, and inferior hardenability.

No. 20 is an example where annealing was performed under the manufacturing condition O, which satisfied the manufacturing condition mentioned in Patent Document 1. Under this manufacturing condition, especially, the heat holding time t1 was 0.5 hour at the temperature T1, which was short. Thus, a large amount of bar-shaped cementite of a small size remained in crystal grains, resulting in the average size of all the cementite being not larger than or equal to the certain level, higher hardness after the spheroidizing annealing than the reference value, and inferior cold-workability.

No. 21 is an example where annealing was performed under the conditions c of Patent Document 2 as the manufacturing condition P that satisfied the manufacturing conditions shown in Patent Document 2. Under this manufacturing condition, holding of the temperature at T1 was not performed, or the like. Thus, a large amount of bar-shaped cementite of a small size remained in crystal grains, resulting in the average size of all cementite being not larger than or equal to the certain level, the hardness after the spheroidizing annealing not being lower than the reference value, and inferior cold-workability.

In Nos. 22, 23 and 25 to 27, since no cooling-heating process was performed, or the cooling-heating process was not repeated, the coarsening of cementite became insufficient, resulting in the average size of all cementite being not larger than or equal to the certain level, the hardness after the spheroidizing annealing being not less than the reference value, and inferior cold-workability.

In Nos. 28 to 31, since no cooling-heating process was performed, or the cooling-heating process was not repeated, the coarsening of cementite became insufficient, resulting in the average size of all cementite being not larger than or equal to the certain level, the hardness after the spheroidizing annealing being not less than the reference value, and inferior cold-workability.

The present application claims priority to Japanese Patent Application No. 2021-061572 and Japanese Patent Application No. 2021-211498, the disclosures of which are incorporated herein by reference in its entirety.

INDUSTRIAL APPLICABILITY

The steel wire for machine structural parts according to the present embodiment exhibited excellent cold-workability, such as low deformation resistance at room temperature when manufacturing various machine structural parts, the ability to suppress wear and fracture of plastic working jigs such as dies, and the ability to suppress cracking during heading, for example. Further, the steel wire can also ensure high hardness by means of the quenching process after the cold-working because of its excellent hardenability. For these reasons, the steel wire for machine structural parts according to the present embodiment is useful as a steel wire for cold-working machine structural parts. For example, the steel wire for machine structural parts according to the present embodiment can be used to manufacture various machine structural parts, such as automobile parts and construction machinery parts, by performing cold working such as cold forging, cold heading, and cold rolling. Specific examples of such machine structural parts, electrical parts and the like, which include machinery parts, such as bolts, screws, nuts, sockets, ball joints, inner tubes, torsion bars, clutch cases, cages, housings, hubs, covers, cases, bearing washers, tappets, saddles, bulgs, inner cases, clutches, sleeves, outer races, sprockets, cores, stators, anvils, spiders, rocker arms, bodies, flanges, drums, joints, connectors, pulleys, fittings, yokes, mouthpieces, valve lifters, spark plugs, pinion gears, steering shafts, and common rails.

The invention claimed is:

1. A steel wire suitable for a machine structural part, comprising, in mass percentage:

Fe;

C in a range of from 0.05 to 0.60%;

Si in a range of from 0.005 to 0.50%;

Mn in a range of from 0.30 to 1.20%;

P in a range of from more than 0 to 0.050%;

S in a range of from more than 0 to 0.050%;

Al in a range of from 0.001 to 0.10%;

Cr in a range of from more than 0 to 1.5%;

N in a range of from more than 0 to 0.02%; and inevitable impurities, wherein a proportion of an area of cementite present at ferrite grain boundaries in an area of all cementite of the steel wire is 32% or more, and wherein, when a C content, in mass percentage, of a steel of the steel wire is expressed as [C], an average circular-equivalent diameter of all the cementite is in a range of from (1.668-2.13 [C]) to (1.863-2.13 [C]) μm.

2. The steel wire of claim 1, which satisfies one or more of (a) to (c):

(a) further comprising, in mass percentage, Cu in a range of from more than 0 to 0.25%, Ni in a range of from more than 0 to 0.25%, Mo in a range of from more than 0 to 0.50%, and/or B in a range of from more than 0 to 0.01%;

(b) further comprising, in mass percentage, Ti in a range of from more than 0 to 0.2%, Nb in a range of from more than 0 to 0.2%, and/or Vin a range of from more than 0 to 0.5%; and/or (c) further comprising, in mass percentage, Mg in a range of from more than 0 to 0.02%, Ca in a range of from more than 0 to 0.05%, Li in a range of from more than 0 to 0.02%, and/or REM in a range of from more than 0 to 0.05%.

3. The steel wire of claim 1, wherein an average ferrite grain size is 30 μm or less.

4. A method for manufacturing the steel wire of claim 1, the method comprising:

subjecting a bar steel to spheroidizing annealing, the spheroidizing annealing comprising (1) to (3):

(1) heating the bar steel to a temperature T1 of (A1+8° C.) or higher, and then heating and holding the bar steel at the temperature T1 for more than 1 hour and 6 hours or less;

(2) performing a cooling-heating process two to six times in total, wherein the cooling-heating process comprises cooling the bar steel to a temperature T2 of higher than 650° C. and (A1−17° C.) or lower at an average cooling rate R1 of 10° C./hour to 30° C./hour, and then heating the bar steel to a heating temperature of higher than the temperature T2 and (A1+60° C.) or lower; and (3) cooling the bar steel from the heating temperature of the final cooling-heating process, where A1 is calculated by equation (1):

$$A1(^\circ\,C.)=723+29.1\times[Si]-10.7\times[Mn]+16.9\times[Cr]-16.9\times[Ni] \quad (1),$$

where an expression [element] is a mass percentage of each element, and the content of an element not contained is zero, wherein the bar steel in the subjecting comprises, in mass percentage:

Fe;

C in a range of from 0.05 to 0.60%;

Si in a range of from 0.005 to 0.50%;

Mn in a range of from 0.30 to 1.20%;

P in a range of from more than 0 to 0.050%;

S in a range of from more than 0 to 0.050%;

Al in a range of from 0.001 to 0.10%;

Cr in a range of from more than 0 to 1.5%;

N in a range of from more than 0 to 0.02%; and inevitable impurities, wherein a proportion of an area of cementite present at ferrite grain boundaries in an area of all cementite of the steel wire is 32% or more, and wherein, when a C content, in mass percentage, of a steel of the steel wire is expressed as [C], an average circular-equivalent diameter of all the cementite is in a range of from (1.668-2.13[C]) to (1.863-2.13 [C]) μm.

5. The method of claim 4, wherein the bar steel is a steel wire obtained by subjecting a wire rod to wire drawing at an area reduction ratio of more than 5%.

6. The steel wire of claim 2, wherein an average ferrite grain size is 30 μm or less.

7. The method of claim 4, wherein the steel further comprises, in mass percentage:

(a) Cu in a range of from more than 0 to 0.25%, Ni in a range of from more than 0 to 0.25%, Mo in a range of from more than 0 to 0.50%, and/or B in a range of from more than 0 to 0.01%;

(b) Ti in a range of from more than 0 to 0.2%, Nb in a range of from more than 0 to 0.2%, and/or V in a range of from more than 0 to 0.5%; and/or (c) Mg in a range of from more than 0 to 0.02%, Ca in a range of from more than 0 to 0.05%, Li in a range of from more than 0 to 0.02%, and/or REM in a range of from more than 0 to 0.05%.

8. The method of claim 7, wherein the bar steel is a steel wire obtained by subjecting a wire rod to wire drawing at an area reduction ratio of more than 5%.

9. The steel wire of claim 1, further comprising:
Cu in a range of from more than 0 to 0.25 wt. %.

10. The steel wire of claim 1, further comprising:
Ni in a range of from more than 0 to 0.25 wt. %.

11. The steel wire of claim 1, further comprising:
Mo in a range of from more than 0 to 0.50 wt. %.

12. The steel wire of claim 1, further comprising:
B in a range of from more than 0 to 0.01 wt. %.

13. The steel wire of claim 1, further comprising:
Ti in a range of from more than 0 to 0.2 wt. %.

14. The steel wire of claim 1, further comprising:
Nb in a range of from more than 0 to 0.2 wt. %.

15. The steel wire of claim 1, further comprising:
V in a range of from more than 0 to 0.5 wt. %.

16. The steel wire of claim 1, further comprising:
Mg in a range of from more than 0 to 0.02 wt. %.

17. The steel wire of claim 1, further comprising:
Ca in a range of from more than 0 to 0.05 wt. %.

18. The steel wire of claim 1, further comprising:
Li in a range of from more than 0 to 0.02 wt. %.

19. The steel wire of claim 1, further comprising:
REM in a range of from more than 0 to 0.05 wt. %.

* * * * *